US005647094A

United States Patent [19]

Mariel

[11] Patent Number: 5,647,094

[45] Date of Patent: Jul. 15, 1997

[54] SLIDING MEMBER FOR REGULATOR ASSEMBLY

[75] Inventor: James Gregory Mariel, Mishawaka, Ind.

[73] Assignee: Excel Industries, Elkhart, Ind.

[21] Appl. No.: 521,271

[22] Filed: Aug. 30, 1995

[51] Int. Cl.[6] ..... A47H 15/00; E05D 15/00

[52] U.S. Cl. ..... 16/93 R; 49/351

[58] Field of Search ..... 16/93 R, 193, 16/87 R, 90, 91, 95 R, 45, 42 R; 49/351, 350, 349, 375

[56] References Cited

U.S. PATENT DOCUMENTS

| | | | |
|---|---|---|---|
| 1,712,588 | 5/1929 | Small | 16/93 R |
| 3,466,802 | 9/1969 | Doveinis et al. | 16/93 R |
| 3,466,803 | 9/1969 | Packett | 16/93 R |
| 3,713,186 | 1/1973 | Cartwright | 16/45 |
| 4,722,150 | 2/1988 | Jacobs et al. | 16/91 |
| 4,825,594 | 5/1989 | Escaravage | 49/351 |
| 4,829,630 | 5/1989 | Church et al. . | |
| 4,882,805 | 11/1989 | Campbell et al. . | |
| 4,935,986 | 6/1990 | Church et al. . | |
| 5,036,621 | 8/1991 | Iwasaki . | |
| 5,120,151 | 6/1992 | Farris et al. . | |
| 5,195,211 | 3/1993 | Krajenke . | |
| 5,337,519 | 8/1994 | Bergesio | 49/351 |

*Primary Examiner*—Chuck Y. Mah
*Attorney, Agent, or Firm*—Banner & Witcoff, Ltd.

[57] ABSTRACT

An improved sliding member for a regulator assembly has a slide body providing a substantially spherical working contact surface and attachment means extending from the slide body for mounting the sliding member to another member of the regulator assembly. The slide body can be substantially mushroom-shaped, having a cap portion and a hub portion, wherein the cap portion forms the substantially spherical working contact surface and includes a substantially curvo-annular flange coaxially surrounding the hub portion. The attachment means can be provided as an attachment stud having a head portion embedded in the slide body, preferably extending coaxially through the hub portion. One or more flexure gaps can be provided in the curvo-annular flange to provide improved compressive fit of the sliding member within a guide channel. A regulator assembly incorporating the sliding member can provide such guide channel as a tube channel in an elongate guide member. The tube channel has an axially extending slot for the attachment stud and a substantially circular cross-section inner slide surface. The substantially spherical working contact surface of the sliding member forms sliding contact, preferably with an interference or compressive fit, with the inner slide surface of the tube channel.

7 Claims, 3 Drawing Sheets

SLIDING MEMBER FOR REGULATOR ASSEMBLY

FIELD OF THE INVENTION

This invention relates to improvements in sliding members for regulator assemblies and also to regulator assemblies incorporating such new sliding members.

BACKGROUND

Regulator assemblies are used for controlling the movement of a pane or panel, for example, window panes mounted for vertical movement to open and close the window opening in a motor vehicle door. Various different types of regulator assemblies are known, including arm and sector regulator assemblies wherein one or more regulator arms translates rotary force from a hand crank, electric motor, etc., into vertical window movement. Frequently a sliding member interconnects the regulator arm and the window or a window carrying member. Regulator assemblies may also employ driven cables for transmitting vertical or horizontal movement to the window pane.

One or more sliding members may be used in a regulator assembly, mounted for travel in a guide channel. Sliding members for window regulator assemblies are shown, for example, in U.S. Pat. Nos. 4,829,630, 4,882,805, 4,935,986, and 5,036,621, and in the various prior patents discussed or mentioned therein. As noted in some of those prior patents, it has been a continuing problem, particularly for regulator assemblies intended for use in motor vehicle applications, to prevent sliding members from raffling in their guide channels. The sliding members must slide with relative ease within the guide channels, and yet must maintain a tight sliding fit within the channel, preferably an interference or compression fit, even after prolonged usage. Prior efforts to prevent raffle of the sliding members have included biasing them in one or more lateral directions within their guide channel. In some cases this has involved using sliding members of complicated mechanical design with several cooperating pieces and spring elements. Such multi-component designs typically have unacceptably high manufacture and assembly costs and/or have proven unreliable over long-term usage. Alternative approaches have employed sliding members comprising essentially a molded plastic unit of complex design. Complex plastic moldings for sliding members, such as those shown in above-mentioned U.S. Pat. No. 4,829,630, have undesirably high production costs. In addition, the sliding members of that patent, due to their rectangular shape, can rotate slightly within their guide channel causing binding. Furthermore, an attachment stud is required in that design to be rotatably or pivotably received in a ball socket formed in the sliding member. Such complexity adds to the cost and long-term performance concerns.

It is an object of the present invention to provide a sliding member for a regulator assembly which provides good long-term performance characteristics, even for motor vehicle window applications, and which are relatively simple in design and manufacture. Additional objectives will become apparent from the following disclosure.

SUMMARY OF THE INVENTION

In accordance with a first aspect, a sliding member is provided for a regulator assembly, comprising a slide body having a substantially spherical working contact surface and means for mounting or attaching the slide body to another member of the regulator assembly. Preferably the mounting means of the sliding member comprises an attachment stud having a head portion embedded in the slide body. Alternatively, the attachment stud can be formed as a unitary extension of the slide body. In accordance with additional preferred aspects, the slide body can be substantially mushroom-shaped for improved performance in providing an interference or compression fit within a guide channel. It will be recognized by those who are skilled in the art, that is, those who are knowledgeable and skilled in this area of technology, that excellent performance characteristics can be achieved with the sliding members disclosed here, with advantageous simplicity of design and manufacture and corresponding cost advantages. These and other advantages will be better understood in view of the detailed description provided below of certain preferred embodiments.

In accordance with another aspect a regulator assembly is provided for controlled movement of a pane, for example, vertical or horizontal movement of a window pane in the window opening of a motor vehicle door. The regulator assemblies disclosed here incorporate a sliding member as described above and an elongate guide member forming a tube channel having a substantially circular cross-section inner slide surface. The slide body is received within the tube channel for longitudinal travel therein, with sliding contact between the substantially spherical working contact surface of the sliding member and the inner slide surface of the tube channel. In certain preferred embodiments the regulator assembly is an arm-and-sector assembly and the elongate guide member is mounted along a bottom edge of a vertically moveable window pane. In such embodiments the attachment stud of the sliding member preferably is rotatably mounted in a mounting aperture of a regulator arm which extends to a sector gear driven by a hand-crank, electric motor, etc. In a cross-arm regulator assembly, preferably both regulator arms carry a sliding member as disclosed above separately received in the tube channel of the same or different guide rafts. The advantages mentioned above with respect to the improved sliding members can be achieved by regulator assemblies incorporating such sliding members. Here, again, additional features and advantages will be recognized by those skilled in the art from the following detailed discussion of certain preferred embodiments.

BRIEF DESCRIPTION OF THE DRAWINGS

Certain preferred embodiments are described below with reference to the appended drawings wherein.

Figure 1:
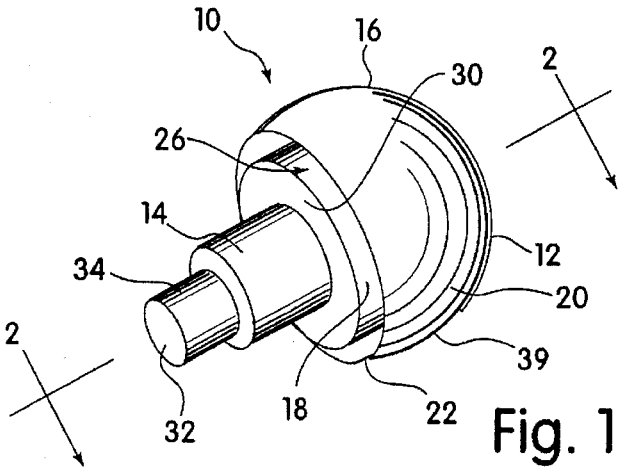
FIG. 1 is a perspective view of a sliding member for a regulator assembly in accordance with a first preferred embodiment.

The same reference numeral is used for a given feature or element in each drawing in which it appears. It should be understood that the drawings are somewhat schematic and not necessarily to scale, to permit greater clarity in the disclosure and description of the invention. All directional references appearing in the discussion below refer to the orientation shown in the drawings unless stated otherwise. It should be understood, however, that the sliding members disclosed here, as well as the regulator assemblies incorporating such sliding members, can be used in many different applications and orientations involving, for example, vertical or horizontal sliding directions, etc.

DETAILED DESCRIPTION OF CERTAIN PREFERRED EMBODIMENTS

The preferred embodiments described below involve cross arm regulator assemblies, such as those incorporating an arm-and-sector gear drive mechanism. It should be understood, however, that the improved sliding members disclosed here can be used to good advantage also in other types of regulator assemblies. The design features and principals of operation described in the preferred embodiments below will be readily applicable by those skilled in the art to such alternative types of regulator assemblies.

Figure 2:
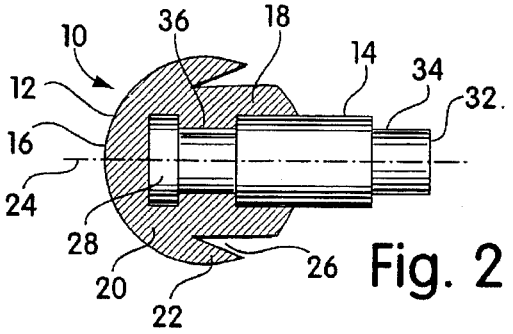
FIG. 2 is a cross-sectional view of the sliding member of FIG. 1, taken through line 2—2 of that drawing.
Figure 3:
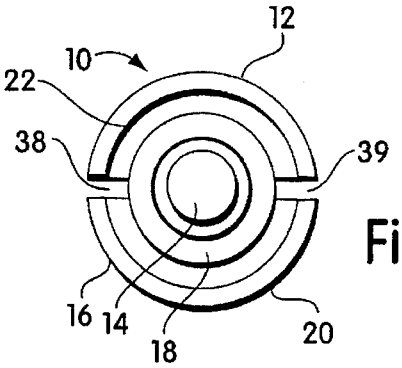
FIG. 3 is a rear elevation view of the sliding member of FIGS. 1 and 2.

The sliding member 10 illustrated in FIGS. 1–3 is seen to include a slide body 12 and an attachment stud 14. The slide body 12 in the preferred embodiment illustrated in FIGS. 1–3 is substantially mushroom-shaped. It has a cap portion 16 and a hub portion 18. The sliding member has a substantially spherical working contact surface 20 which, in the preferred embodiment shown in the drawings, is provided by the aforesaid cap portion 16. Cap portion 16 extends rearwardly in the form of a substantially curvo-annular flange 22 coaxially surrounding the substantially cylindrical hub portion 18. That is, the curvo-annular flange 22 is co-axial with the hub portion 18, being separated therefrom by a substantially annular recess 26. As best seen in FIG. 2, recess 26 is tapered in the illustrated embodiment. It will be understood by those skilled in the art that the "curvo-annular flange" is essentially annular, like a ring or short length of pipe. Rather than having a straight wall as in a "right cylinder", however, the outside or both surfaces of the curvo-annular flange are curved. In particular, the outside surface at least is curved to extend the aforesaid substantially spherical working contact surface 20. Thus, while both the inside and outside surface of the curvo-annular flange 22 are curved, of course, in a plane normal to the axis of the hub portion 18 (hence, being annular), the outside surface at least is also curved in a plane bisecting the slide body along the longitudinal axis 24 of the sliding member 10 (hence being "curvo-annular"). It will be recognized from the drawings that the longitudinal axis 24 of the sliding member 10 is also the longitudinal axis of the slide body 12, cap portion 16, annular flange 22, hub portion 18 and attachment stud 14. The substantially symmetrical configuration of the illustrated embodiment is advantageous for the simplicity of its design and manufacture.

The attachment stud 14 is seen to comprise a head portion 28 which is non-rotatably embedded in the slide body 10. The attachment stud is substantially cylindrical and extends rearwardly (to the right as viewed in FIG. 2) beyond the rear face 30 of the hub portion 18 of the slide body 12. The reduced diameter portion 36 of the attachment stud 14 aids in insuring that the attachment stud remains firmly embedded within the slide body. Also, the hub portion 18 preferably extends rearwardly of the curvo-annular flange, advantageously providing rigidity and structural support to the attachment stud. At its distal end, that is, its free end, the attachment stud 14 forms a mounting pin 34 of somewhat reduced diameter, with end face 32. Such mounting pin is suitable to be rotatably received in a mounting aperture regulator arm or other member of a regulator assembly. Numerous suitable alternative attachment means for mounting the sliding member in a regulator assembly, including suitable alternative configurations for the attachment stud 14 shown in the preferred embodiment illustrated in FIGS. 1 through 3, will be readily apparent to those skilled in the art in view of this disclosure. Generally, the specific design will depend largely on the particular application for which the sliding member is intended. The illustrated embodiment is particularly advantageous in view of its simplicity of design and manufacture.

The slide body 12 preferably is formed of molded plastic material, for example, injection molded nylon or the like. The attachment stud preferably is formed of steel or other suitable metal and can advantageously be integrated with the slide body by a simple insert molding technique or other suitable method. Alternatively, in certain applications it may be suitable to form the attachment stud as a unitary extension of the molded plastic slide body. Since the substantially spherical contact working surface of the slide body can rotate within a guide channel of a regulator assembly (described further below) by means of their sliding contact, the complexity and cost of providing a rotatable junction between the attachment stud and the slide body can advantageously be avoided.

As mentioned above, the slide body preferably is received into a slide channel of the regulator assembly with an interference or compression fit. In the preferred embodiment of FIGS. 1–3, such compression fit is facilitated by means of flexure gaps 38 and 39 in the curvo-annular flange 22. Slight compression of the substantially spherical working contact surface of the slide body at initial installation of the sliding member into a slide channel can advantageously result in automatic compensation for any reduction in the outside diameter of the spherical surface due to temperature changes, surface wear over the course of prolonged use, etc. In this way, rattle of the sliding member within the slide channel is further reduced or eliminated. Preferably such flexure gaps are substantially equally spaced circumferentially about the curvo-annular flange. It will be well within the ability of those skilled in the art to select suitable molded plastic or other material for the slide body having a degree of flexibility and memory, along with a suitable number, size and position of flexure gaps to provide a desired degree of compressive fit for the slide body within the slide channel. In the alternative preferred embodiment illustrated in FIG. 4, the curvo-annular flange is uninterrupted by flexure gaps.

Figure 5:
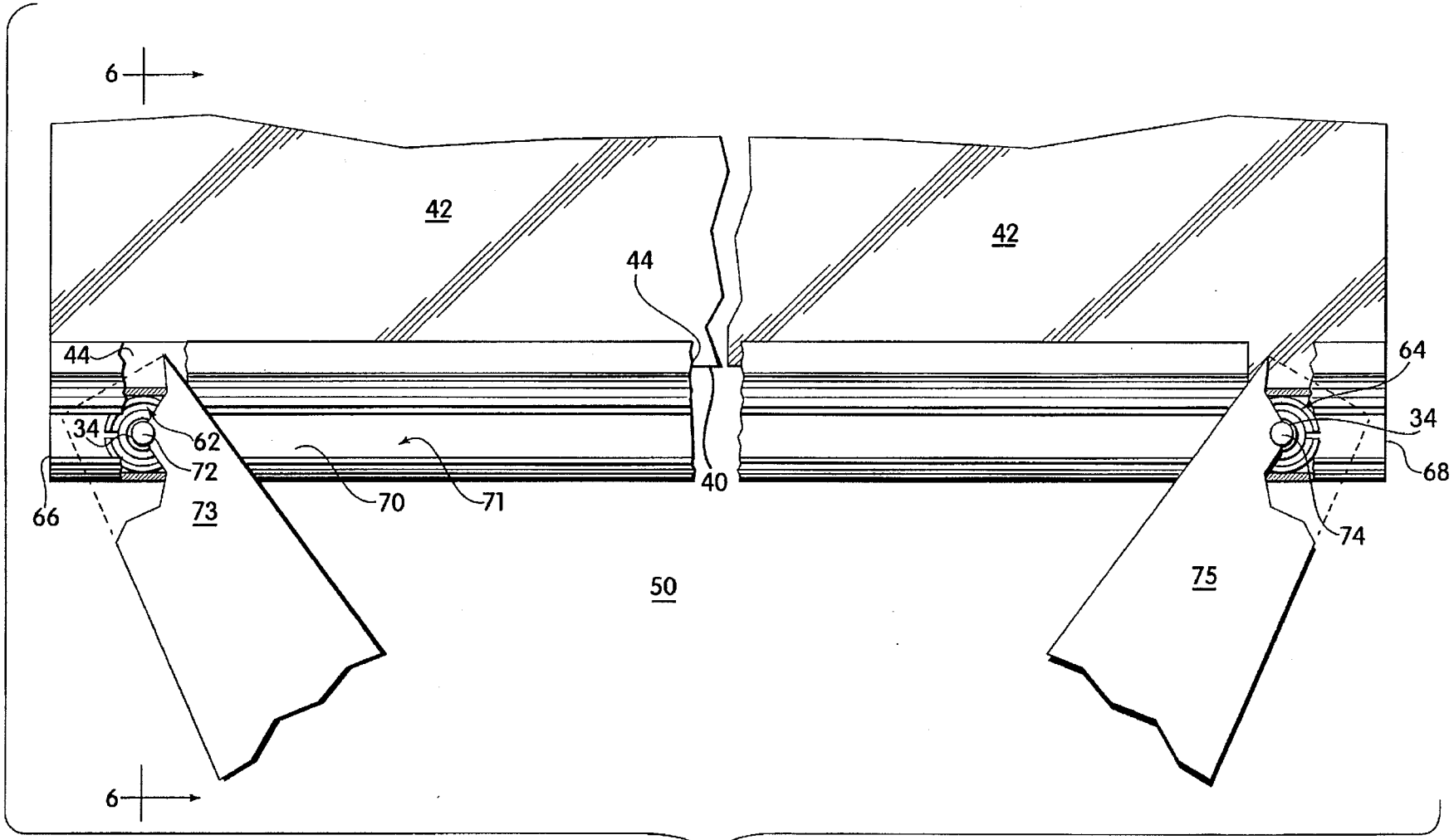
FIG. 5 is a schematic elevation view, partially broken away, of a window regulator assembly incorporating the sliding member of FIGS. 1–3.
Figure 6:
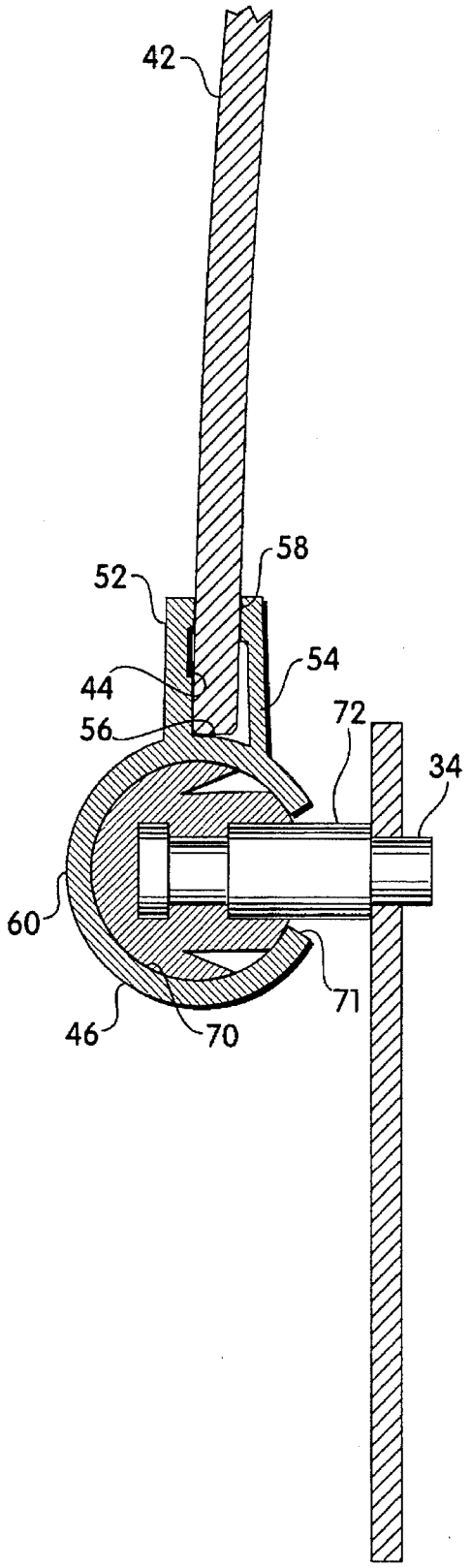
FIG. 6 is a cross-sectional view of the window regulator assembly of FIG. 5, taken through line 6—6 of that drawing.

A regulator assembly incorporating a pair of sliding members such as the sliding member 10 of FIGS. 1–3 is illustrated in FIGS. 5 and 6. The bottom horizontal edge 40 of a transparent glass pane 42 is received into the upwardly-open pane mounting channel 44 formed by an elongate guide rail 46. Guide rail 46 is moved vertically to position the glass up or down, as desired, in the window opening 48 of a vehicle door 50. Suitable additional guide members and mounting fixtures are well known to those skilled in the art and will be readily apparent in view of the present disclosure. The pane mounting channel 44 of guide rail 46 is seen to be substantially U-shaped in cross section, being defined by a front flange or lip 52 and a rear flange or lip 54. In the illustrated embodiment, bottom edge 40 of glass pane 42 rests on the base or bottom surface 56 of the pane mounting channel 44. Optionally, additional pane securing means may be employed, such as adhesive or the like within the pane mounting channel. Pane gripping teeth 58 or the like also can be formed, for example, by suitable metal stamping techniques, etc., in the front and/or rear flange of the pane mounting channel to assist in securing the pane within the channel.

Figure 4:
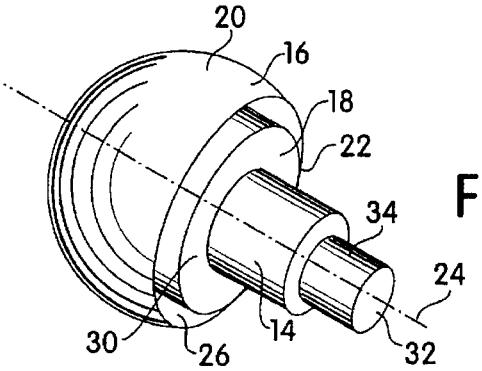
FIG. 4 is a perspective view similar to the view of FIG. 1, showing a sliding member in accordance with a second preferred embodiment.

The guide rail 46 further provides tube channel 60 for receiving the aforesaid pair of sliding members 62, 64 having the same design and configuration as the sliding member 10 illustrated in FIGS. 1–3. The guide rail preferably has a substantially uniform cross section and can be formed, for example, by extrusion or other suitable manufacturing techniques. The sliding members 62, 64 can be inserted into the tube channel during initial construction of the regulator assembly at either open end 66, 68. Optionally, end caps or other means for preventing travel of the sliding members out of the tube channel can be provided in accordance with known techniques and designs. Tube channel 60 has a substantially circular cross-section inner slide surface 70 sized to receive the substantially spherical working contact surface 20 (using the corresponding reference number from FIGS. 1–3) with a slight compressive fit. Thus, sliding contact is achieved between the substantially spherical working contact surface of the sliding members and the inner slide surface of the tube channel. In that regard, it should be recognized that the working contact surface of the slide body is said to be substantially spherical in the sense that at least that portion of the surface which contacts the inner surface of the tube channel of the guide rail is spherical. Typically, only about 60 to 80 percent of a full sphere is formed by the working surface of the slide body, as in the embodiment illustrated in the drawings. Also, it should be understood that the substantially circular cross-section tube channel has a longitudinal open slot 71 rather than forming a complete circle. Thus, in cross-section the tube channel forms a C-shape. The slot 71 provides a travel way for the attachment studs of the two sliding members. The attachment studs extend out of the sliding bodies in the tube channel to regulator arms of the regulator assembly. More specifically, the attachment stud 72 of sliding member 62 extends to left side regulator arm 73 at which it forms a reduced diameter mounting pin 34 which is rotatably mounted in a corresponding aperture in the regulator arm 73. The mounting pin 34 is retained in the regulator arm aperture preferably by spin riviting its end face 32 (end face 32 is best seen in FIGS. 1,2 and 4). Similarly, attachment stud 74 of right side sliding member 64 extends to fight side regulator arm 75 at which it forms a reduced diameter mounting pin 34 rotatably mounted and spin rivited in a corresponding aperture in the regulator arm 75. As an alternative to spin riviting, suitable C-rings or other means well known to those skilled in the art can be used to secure the mounting pins of the attachment studs to the regulator arms. As noted above, it will be well within the ability of those skilled in the an given the present disclosure to select design details for the improved sliding members and regulator assemblies disclosed here.

It is a significant advantage of the illustrated embodiment that the slide body can swivel and turn to a limited extent within the tube channel, providing a limited universal connection with the guide rail. As the angle of the regulator arms to the guide rail changes during operation of the regulator assembly, a corresponding relative rotation must be accommodated. The substantially spherical contact working surface of the sliding member allows the rotation to be accommodated by rotation of the sliding member within the tube channel as it is also traveling longitudinally therein. In addition, as noted above, the mounting pin can be rotatably mounted to the regulator arm. The limited universal connection, however, also accommodates other minor changes in the relative orientation of the regulator arms to the guide rail during operation of the regulator assembly, thereby facilitating smooth and reliable operation.

Those skilled in the art will recognize that various additions and/or modifications can be made to the preferred embodiments described above without departing from the true scope and spirit of the present invention. All such additions and modifications are intended to be covered by the following claims.

I claim:

1. A sliding member for a regulator assembly, comprising a slide body having a substantially spherical working contact surface and an attachment stud having a head portion embedded in the slide body, wherein the slide body is substantially mushroom-shaped, having a cap portion and a hub portion, the cap portion forming the substantially spherical working contact surface and including a substantially curvo-annular flange coaxially surrounding the hub portion, the hub portion being unitary at its forward end with the cap portion and spaced from the curvo-annular flange of the cap portion by a substantially annular recess in the slide body.

2. The sliding member of claim 1 wherein the cap portion of the slide body has at least one flexure gap in the curvo-annular flange.

3. The sliding member of claim 1 wherein the hub portion extends axially rearward beyond the curvo-annular flange of the cap portion of the slide body.

4. A regular assembly for controlled movement of a pane, comprising:

a sliding member comprising a slide body having a substantially spherical working contact surface and an attachment stud having a head portion embedded in the slide body; and an elongate guide member forming a tube channel having a longitudinal open slot for the attachment stud and a substantially circular cross-section inner slide surface, the slide body being received within the tube channel for longitudinal travel therein with sliding contact between the substantially spherical working contact surface of the sliding member and the inner slide surface of the tube channel, wherein the slide body is substantially mushroom-shaped, having a cap portion and a hub portion, the cap portion forming the substantially spherical working contact surface and including a substantially curvo-annular flange coaxially surrounding the hub portion, the hub portion being unitary at its forward end with the cap portion and spaced from the curvo-annular flange of the cap portion by a substantially annular recess in the slide body.

5. The regulator assembly in accordance with claim 4 wherein the cap portion of the slide body has at least one flexure gap in the curvo-annular flange.

6. A window regulator assembly for controlled up and down movement of a window pane in a motor vehicle door window opening, the window regulator assembly comprising:

a) at least two substantially identical sliding members, each said sliding member comprising:

a substantially mushroom shaped slide body having a cap portion and a substantially cylindrical hub portion which is unitary with the cap portion, the cap portion forming a substantially spherical working contact surface and including a substantially curvo-annular flange spaced from the hub portion by a tapered annular recess in the slide body; and a substantially cylindrical attachment stud having a head portion non-rotatably embedded in the slide body and forming a reduced diameter mounting pin at a free end opposite the embedded head portion;

b) an elongate, substantially horizontal guide rail of substantially uniform cross-sectional configuration, comprising:

a substantially U-shaped, upwardly open glass channel extending longitudinally along the guide rail for receiving a lower edge of the window pane; and a laterally open tube channel extending longitudinally along the guide rail and receiving the sliding members for longitudinal travel therein, having a substantially circular cross-section inner slide surface making sliding contact with the substantially spherical working contact surface of each of the two sliding members; and c) at least two regulator arms for raising and lowering the guide rail and window pane, each of the regulator arms having a mounting aperture rotatably receiving the mounting pin of a corresponding one of the sliding members.

7. The window regulator assembly in accordance with claim 6 wherein the cap portion of the slide body has at least one flexure gap in the curvo-annular flange, providing a compression fit of the slide body in the tube channel.

* * * * *